US006965286B2

(12) United States Patent
Rawnick et al.

(10) Patent No.: US 6,965,286 B2
(45) Date of Patent: Nov. 15, 2005

(54) TUNABLE RESONANT CAVITY USING CONDUCTIVE FLUIDS

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 38 days.

(21) Appl. No.: 10/414,695

(22) Filed: Apr. 16, 2003

(65) Prior Publication Data

US 2004/0207495 A1 Oct. 21, 2004

(51) Int. Cl.[7] ..... H01P 7/06
(52) U.S. Cl. ..... 333/235; 333/227; 333/202
(58) Field of Search ..... 333/202, 209, 333/219, 227, 231, 229, 232, 234, 235

(56) References Cited

U.S. PATENT DOCUMENTS 4,152,567 A * 5/1979 Mayfield ..... 219/688
5,792,236 A 8/1998 Taylor et al. ..... 75/715

OTHER PUBLICATIONS

U.S. Appl. No. 10/330,756, filed Dec. 27, 2002, Rawnick et al.
U.S. Appl. No. 10/626,090, filed Jul. 24, 2003,Brown et al.
U.S. Appl. No. 10/632,632, filed Aug. 1, 2003, Rawnick et al.
U.S. Appl. No. 10/625,977, filed Jul. 24, 2003, Rawnick et al.
U.S. Appl. No. 10/614,149, filed Jul. 7, 2003, Brown et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/460,947, filed Jun. 13, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.

* cited by examiner

*Primary Examiner*—Stephen E. Jones
(74) *Attorney, Agent, or Firm*—Sacco & Associates, PA

(57) ABSTRACT

A tunable resonant system (100) and a method for a varying the resonant characteristics of a resonant cavity (102). The resonant cavity is enclosed by a conductive material that has at least one aperture (104) for coupling the resonant cavity to an RF signal propagating in a circuit device (160). A conductive fluid (108) having a permeability is at least partially disposed within the resonant cavity (102) or a plurality of subcavities (250, 252) within the resonant cavity (202). A dielectric barrier (105) can be provided within the aperture to prevent the conductive fluid from escaping the resonant cavity. A composition processor (101) is adapted for dynamically changing a composition or volume of the conductive fluid to vary or maintain constant a center frequency, a bandwidth, a quality factor (Q) or an impedance of the resonant cavity.

25 Claims, 4 Drawing Sheets

300

TUNABLE RESONANT CAVITY USING CONDUCTIVE FLUIDS

BACKGROUND OF THE INVENTION

1. Statement of the Technical Field

The inventive arrangements relate generally to methods and apparatus for providing increased design flexibility for RF circuits and, more particularly, to resonant cavities using conductive fluids.

2. Description of the Related Art

Resonant cavities are well known radio frequency (RF) devices and are commonly used in a variety of RF circuits, for example, in conjunction with microwave antennas and local oscillators. Resonant cavities are typically completely enclosed by conducting walls that can contain oscillating electromagnetic fields. An aperture is generally provided in one of the resonant cavity walls through which RF energy can be transmitted into, and extracted from, the resonant cavity. Resonant cavities can be constructed with a variety of shapes and can be used for different applications and frequency ranges. Nonetheless, the basic principles of operation are the same for all resonant cavities.

A resonant cavity resonates at frequencies which are determined by the dimensions of the resonant cavity. As the cavity dimensions increase, the resonant frequencies tend to decrease, and vice versa. For example, the lowest resonant frequency of a three dimensional rectangular resonant cavity is given by the equation:

$$f = \frac{C_0\sqrt{\frac{1}{a^2}+\frac{1}{b^2}}}{2\sqrt{\mu_r\varepsilon_r}}$$

where a and b the two largest dimensions of the cavity (i.e. length and width), $\in_r$ is the relative permittivity of the dielectric within the resonant cavity, $\mu_r$ is the relative permeability of the resonant cavity, and $C_0$ is the speed of light.

Resonant cavities provide many advantages for RF circuits operating in the microwave frequency range. In particular, resonant cavities have a very high quality factor (Q). In fact, cavities with a Q value in excess of 30,000 are not uncommon. The high Q gives resonant cavities an extremely narrow bandpass, which enables very precise operation of microwave devices utilizing the resonant cavities. In consequence to the narrow bandpass, however, resonant cavities are typically limited to operating only at very specific frequencies.

To alter the resonant frequency of a resonant cavity would typically require a mechanical manipulation of the shape and structure of the dimensions of the cavity. With rigid conventional dielectric or conductive materials, such manipulations would likely be costly and limited to certain specific structures and frequencies. Thus, a need exists for tuning a resonant cavity in a flexible and cost effective manner.

SUMMARY OF THE INVENTION

The present invention relates to a tunable resonant system, which includes a resonant cavity, and a method for a varying the resonant characteristics of the resonant cavity. The resonant cavity is enclosed by a conductive material and has at least one aperture in the conductive material for coupling the resonant cavity to an RF signal propagating in a circuit device, for example an antenna element or an oscillator. A conductive fluid having a permeability can be at least partially disposed within the resonant cavity or a plurality of subcavities within the resonant cavity. A dielectric barrier can be provided within the aperture to prevent fluid from escaping the resonant cavity.

In one aspect of the present invention, at least one composition processor or a fluidic pump is adapted for dynamically changing a composition or volume of the conductive fluid to vary the resonant frequency of the resonant cavity. In this manner at least one parameter associated with the resonant cavity can be varied or maintained. The parameter can be a center frequency, a bandwidth, a quality factor (Q) or an impedance. A controller also can be provided for controlling the composition processor in response to a control signal such as a resonant system control signal. The controller can cause the composition processor to selectively vary or alter the volume or types of conductive fluid within the resonant cavity or a plurality of discrete cavities or subcavities within the resonant cavity. The composition processor can include at least one conduit or feed line for selectively pumping conductive fluid from respective fluid reservoirs to the resonant cavity.

The fluidic dielectric used in the various discrete cavities or subcavities of a resonant cavity for example can have different characteristics, for example characteristics selected from (a) a low permittivity, low permeability, (b) a high permittivity, low permeability, and (c) a high permittivity, high permeability. Further, the high permittivity, high permeability fluidic dielectric can have a high loss tangent. The fluidic dielectric can include an industrial solvent which has a suspension of magnetic particles contained therein. The magnetic particles can be formed of ferrite, metallic salts, and organo-metallic particles. Further, the component can contain between about 50% to 90% magnetic particles by weight.

In another aspect of the present invention, a method for varying the resonant characteristics of a resonant cavity includes the step of at least partially filling the resonant cavity or one or more subcavities within the resonant cavity with conductive fluids. The method also includes the step of changing a composition or volume of the conductive fluid to selectively vary at least a permeability value of the resonant cavity in response to a control signal such as a resonant system control signal. The method also can include the step of pumping the conductive fluid from respective fluid reservoirs to the resonant cavity (or to the subcavities within the resonant cavity) to vary or maintain constant, a center frequency, a bandwidth, a quality factor (Q) and/or an impedance associated with the resonant cavity.

DETAILED DESCRIPTION OF THE PREFERRED EMBODIMENTS

The present invention relates to a tunable resonant system. The invention provides the circuit designer with an added level of flexibility by permitting a conductive fluid to be used in a tuned resonant cavity (resonant cavity), thereby enabling the operating properties within resonant cavity to be varied. Since group velocity in a medium is inversely proportional to $\sqrt{\mu\epsilon}$, increasing the permittivity ($\epsilon$) and/or permeability ($\mu$) in the dielectric decreases group velocity of an electromagnetic field within a resonant cavity, and thus the signal wavelength. Accordingly, the permittivity and permeability of the conductive fluid can be selected to decrease the physical size of a resonant cavity and to tune the operational characteristics of the resonant cavity. For example, the permittivity and/or permeability can be adjusted to tune the center frequency of cavity resonances. Further, the loss tangent of the fluidic dielectric can be adjusted in addition to the permittivity and/or permeability in order to tune additional operational parameters, for instance, the quality factor (Q), bandwidth of resonances within the resonant cavity, and an impedance of the resonant cavity. Accordingly, a resonant cavity of a given size can be used for a broad range of frequencies and applications without altering the physical dimensions of the resonant cavity. Moreover, if the physical dimensions of the resonant cavity change, for example due to thermal expansion or contraction, during operation of the resonant cavity, the permittivity, permeability and/or loss tangent of the fluidic dielectric can be automatically adjusted to keep the resonant cavity tuned for optimum performance. Importantly, the present invention eliminates the need for manual adjustments, such as tuning screws, to keep the resonant cavity properly tuned.

Figure 1:
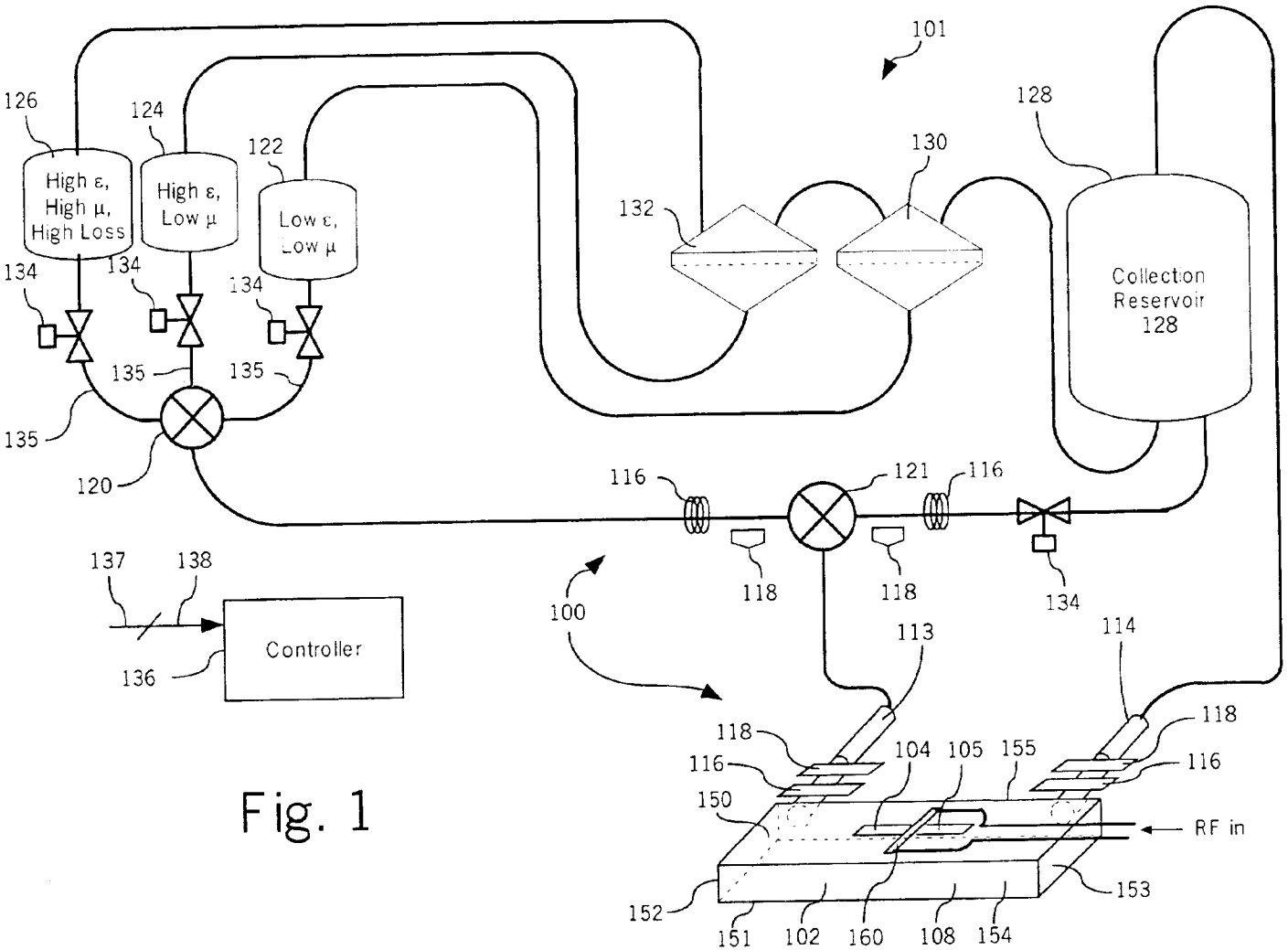
FIG. 1 is a block diagram useful for understanding the tunable resonant cavity in accordance with the present invention.

FIG. 1 is a conceptual diagram that is useful for understanding the tunable resonant cavity of the present invention. The resonant cavity apparatus 100 includes a resonant cavity 102. The resonant cavity 102 can be a cavity enclosed by an electrically or magnetically conductive material, for instance cavity walls 150, 151; 152, 153; 154, 155. The cavity walls can be fabricated from any material that can be used to construct a resonant cavity. For example, the cavity walls can be fabricated steel, brass, copper, ferrite, Invar, etc. Further, the resonant cavity can have a predetermined geometry and can be at least partially filled with a conductive fluid 108. An aperture 104 can be provided in a cavity wall 150 for coupling RF signals to the resonant cavity, for example RF signals propagating in a circuit device.

Figure 2:
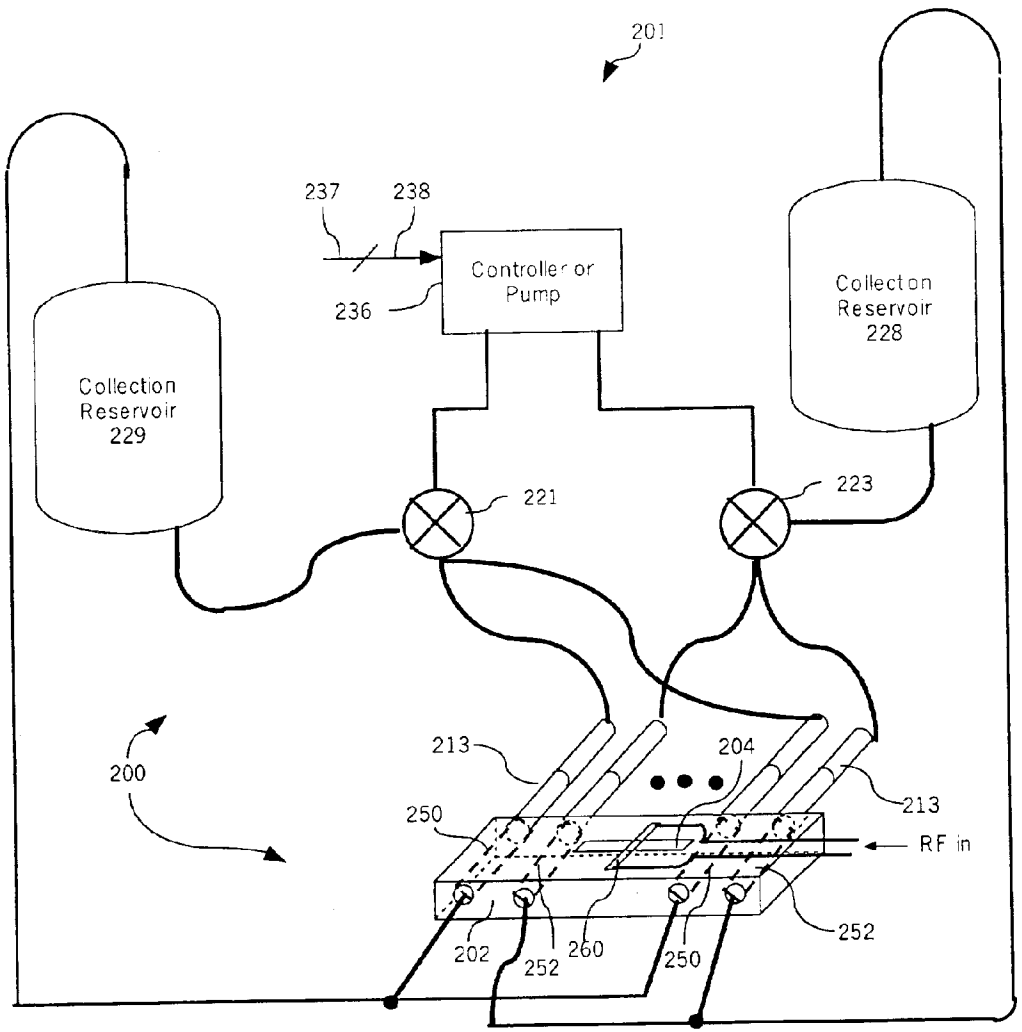
FIG. 2 is another block diagram useful for understanding another tunable resonant cavity in accordance with the present invention.
Figure 3:
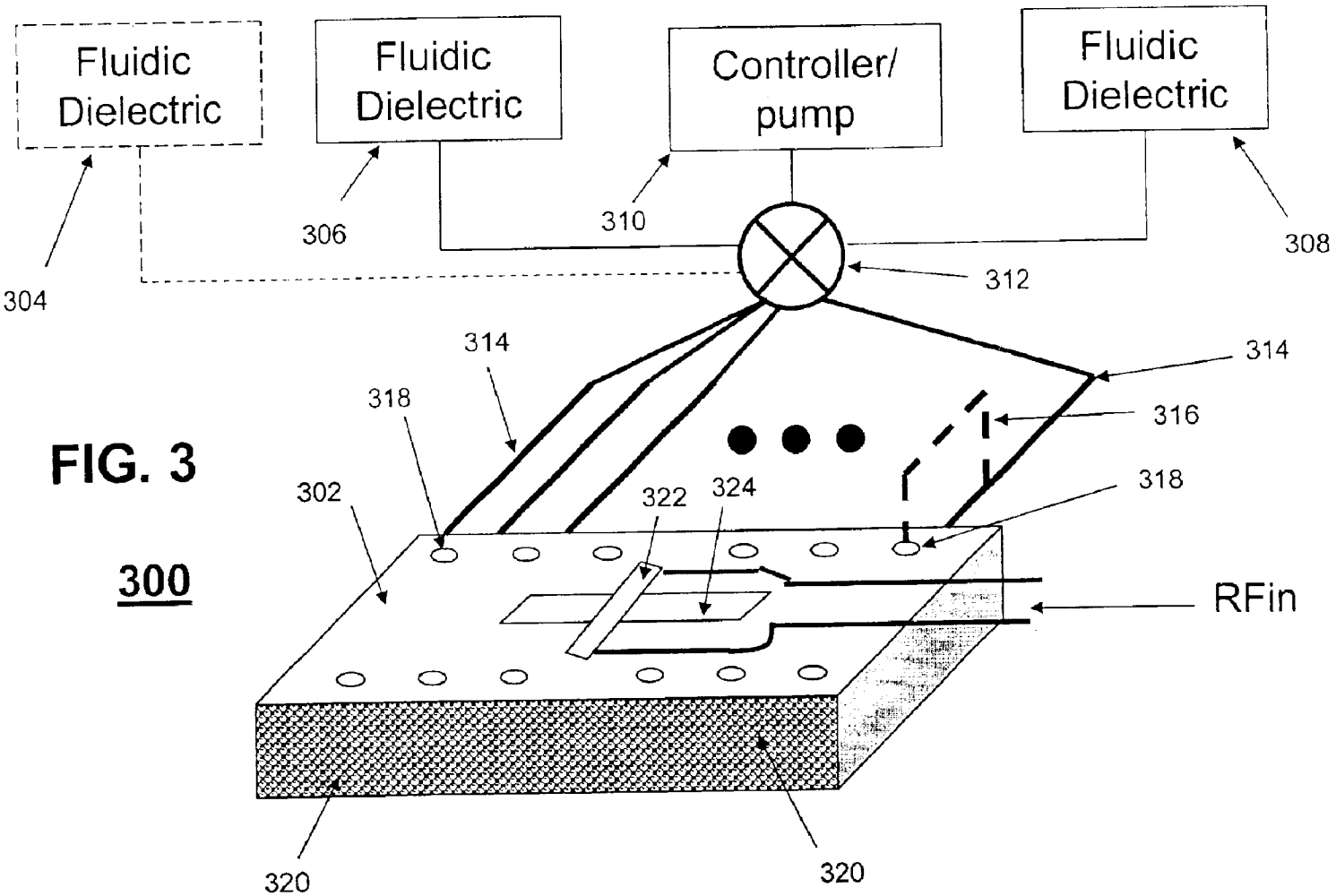
FIG. 3 is yet another block diagram useful for understanding an alternative tunable resonant cavity in accordance with the present invention.

The conductive fluid 108 can be constrained within the resonant cavity 102 generally or within any number of cavities such as multiple capillary tubes as will be further discussed particularly with reference to FIGS. 2 and 3. A dielectric barrier 105 can be placed in the aperture 104 to prevent leakage of the conductive fluid 108 from the resonant cavity 102. The dielectric barrier 105 can be glass, plastic, or any other dielectric material which is impermeable to the conductive fluid 108. Accordingly, the dielectric barrier 105 will maintain the conductive fluid 108 within the resonant cavity 102, while having an insignificant impact on resonant cavity performance.

The resonant cavity 102 can be used in any circuit that can include any other type of resonant cavity. For example, the resonant cavity 102 can be used in conjunction with an antenna element 160, as shown in FIG. 1. The resonant cavity 102 also can be used with other circuit devices, for example an oscillator or a filter. Moreover, the resonant cavity 102 can be used as a filter element. Still, there are many other applications where the resonant cavity 102 can be used, and such applications are understood to be within the scope of the present invention.

A composition processor 101 is provided for changing a composition of the conductive fluid 108 to vary permeability or resonant frequency of the resonant cavity. In effect, the presence or lack of presence of the conductive fluid within the resonant cavity alters the shape or dimensions of the resonant cavity and hence its resonant frequency. A controller 136 controls the composition processor for selectively varying the permeability and/or other characteristics such as permittivity of the conductive fluid 108 in response to a resonant system control signal 137. By selectively varying the permeability and/or permittivity of the conductive fluid, the controller 136 can control group velocity and phase velocity of an RF signal within the resonant cavity 102, and thus resonances within the resonant cavity 102. The permeability and/or permittivity also can be adjusted to control the impedance of the resonant cavity. By selectively varying the loss tangent of the fluidic dielectric along with the permittivity and/or permeability, the controller 136 can control the Q and bandwidth of the resonant cavity 102.

In particular, the center frequencies at which the resonant cavity 102 resonates are determined by the dimensions of the resonant cavity, for example the distance between opposing walls 150, 151; 152, 153; 154, 155. A change in permeability and/or permittivity, which results in a change in phase velocity and group velocity of a signal within a resonant cavity, effectively changes the relative dimensions of the resonant cavity with respect to signal wavelength. Accordingly, the controller 136 can control the center frequencies of the cavity resonances by adjusting the permeability and/or permittivity of the conductive fluid 108. For instance, the permittivity and/or permeability of the conductive fluid 108 can be increased to result in a lower group velocity, which will cause the center frequencies to decrease. Likewise, a decrease in permittivity and/or permeability can increase the center frequencies. Additionally, the permittivity and/or permeability also can be adjusted to tune the impedance of the resonant cavity, which is beneficial for optimizing the RF coupling between the resonant cavity 102 and a circuit element, such as the antenna element 160.

Moreover, the permeability and/or permittivity can be adjusted to maintain a resonant frequency of the resonant cavity 102 constant. For instance, the permeability and/or permittivity can be adjusted to compensate for thermal expansion and contraction of the resonant cavity, such as when a resonant cavity is exposed to temperature extremes or when a substantial amount of power loss occurs in the resonant cavity. Such power loss can occur in a resonant cavity which is used in high power microwave transmission applications.

Composition of Fluidic Dielectric

The conductive fluid can be comprised of several component parts that can be either mixed together or provided in discrete quantized volumes to produce a desired permeability and permittivity required for a particular group velocity and resonant cavity resonant frequencies. In this regard, it will be readily appreciated that fluid miscibility and particle suspension are key considerations to ensure proper mixing. Another key consideration is the relative ease by which the component parts can be subsequently separated from one another. The ability to separate the component parts is important when the operational frequency, bandwidth or Q changes. Specifically, this feature ensures that the component parts can be subsequently re-mixed in a different proportion to form a new conductive fluid. Alternatively, desired permittivity and permeability can be achieved without necessarily mixing the components, but by providing a specific volume of particular component of conductive fluid. Thus, fluid miscibility, particle suspension, and separability may not be an important consideration in an embodiment that depends on discrete volumes of conductive fluid to alter the resonant cavity characteristics.

Many applications also require resonant cavities to be tunable over a wide frequency range. Accordingly, it may be desirable in many instances to select component mixtures or varied volumes of conductive fluid that produce a resonant cavity that has a relatively constant response over a broad range of frequencies. If the conductive fluid is not relatively constant over a broad range of frequencies, the characteristics of the fluid or their volume at various frequencies can be accounted for when the conductive fluid is mixed in a given cavity or pumped in as separate components into separate cavities. For example, a table of permittivity, permeability and loss tangent values vs. frequency can be stored in the controller 136 for reference during the mixing and/or pumping process.

Aside from the foregoing constraints, there are relatively few limits on the range of component parts that can be used to form the conductive fluid. Accordingly, those skilled in the art will recognize that the examples of component parts, mixing, pumping & extracting methods and separation methods as shall be disclosed herein are merely by way of example and are not intended to limit in any way the scope of the invention. Also, the component materials are described herein as being mixed or alternatively pumped in discretized volumes in order to produce the conductive fluid of a given characteristic. However, it should be noted that the invention is not so limited. Instead, it should be recognized that the composition or volume of the conductive fluid could be modified in other ways. For example, the component parts could be selected to chemically react with one another in such a way as to produce the conductive fluid with the desired values of permittivity and/or permeability. All such techniques will be understood to be included to the extent that it is stated that the composition or volume of the fluidic dielectric within the resonant cavity is changed.

A nominal value of permittivity ($\in_r$) for fluids is approximately 2.0. However, the component parts for the conductive fluid can include fluids with extreme values of permittivity. Consequently, a mixture of such component parts can be used to produce a wide range of intermediate permittivity values. For example, component fluids could be selected with permittivity values of approximately 2.0 and about 58 to produce a conductive fluid with a permittivity anywhere within that range after mixing. Dielectric particle suspensions can also be used to increase permittivity.

According to a preferred embodiment, the component parts of the conductive fluid can be selected to include (a) a low permittivity, low permeability, low loss component, (b) a high permittivity, low permeability, low loss component and (c) a high permittivity, high permeability, high loss component. These three components can be mixed as needed for increasing the permittivity while maintaining a relatively constant loss tangent (dielectric or magnetic) and for increasing the loss tangent while maintaining a relatively constant product of permittivity and permeability. Still, a myriad of other component mixtures can be used.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed conductive fluid after mixing. However, magnetic fluid compositions are typically between about 50% to 90% particles by weight. Increasing the number of particles will generally increase the permeability.

An example of a set of component parts that could be used to produce a range of conductive fluids as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the conductive fluid, for example those commercially available from FerroTec Corporation of Nashua, N.H. 03060. In particular, Ferrotec part numbers EMG0805, EMG0807, and EMG1111 can be used.

A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetoresrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

Processing of Conductive Fluids for Mixing/Unmixing or for Moving of Components

The composition processor 101 can be comprised of a plurality of fluid reservoirs containing component parts of conductive fluid 108. These can include: a first fluid reservoir 122 for a low permittivity, low permeability component of the conductive fluid; a second fluid reservoir 124 for a high permittivity, low permeability component of the conductive fluid; a third fluid reservoir 126 for a high permittivity, high permeability, high loss component of the conductive fluid. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the conductive fluid and a fourth fluid reservoir can be provided to contain a component of the conductive fluid having a high loss tangent.

A cooperating set of proportional valves 134, mixing pumps 120, 121, and connecting conduits 135 can be provided as shown in FIG. 1 for selectively mixing and communicating the components of the conductive fluid 108 from the fluid reservoirs 122, 124, 126 to the resonant cavity 102. The composition processor also serves to separate out the component parts of conductive fluid 108 so that they can be subsequently re-used to form the conductive fluid with different attenuation, permittivity and/or permeability values. All of the various operating functions of the composition processor can be controlled by controller 136. The operation of the composition processor shall now be described in greater detail with reference to FIG. 1 and the flowchart shown in FIG. 4.

Figure 4:
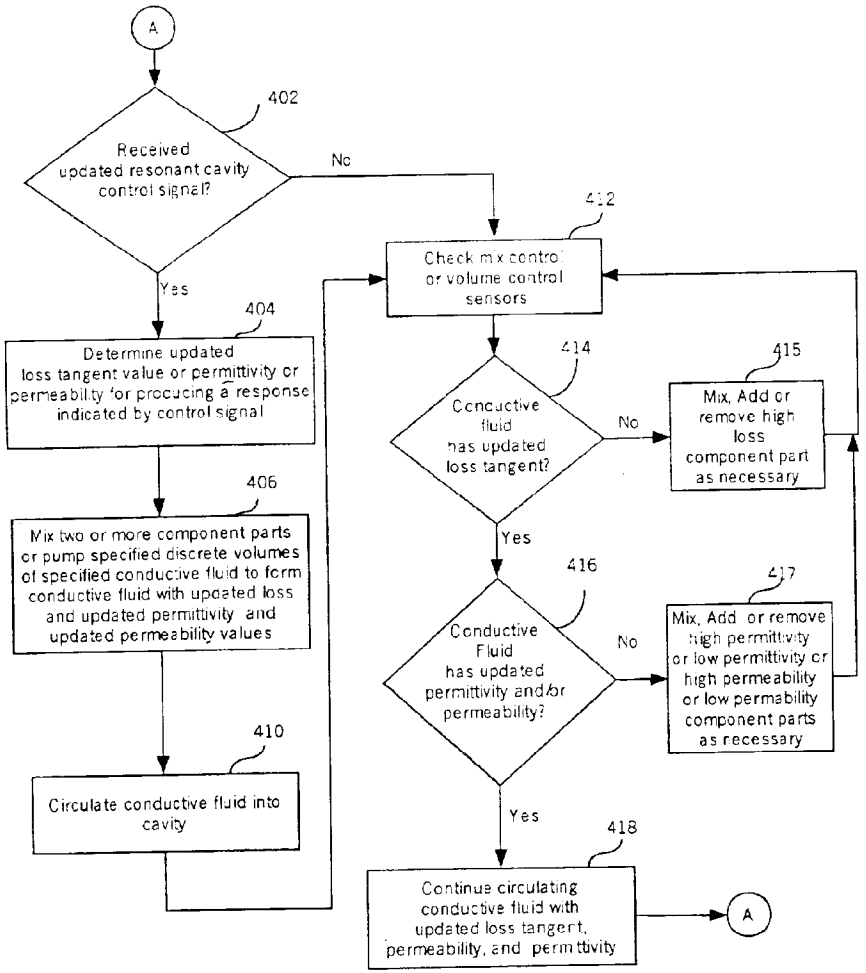
FIG. 4 is a flow chart illustrating a method in accordance with the present invention.

The process can begin in step 402 of FIG. 4, with controller 136 checking to see if an updated resonant system control signal 137 has been received on a controller input line 138. If so, then the controller 136 continues on to step 404 to determine an updated permeability value and/or an updated loss tangent value and/or an updated permittivity value. The updated loss tangent value will be for producing the Q indicated by the resonant system control signal 137. The updated loss tangent value necessary for achieving the indicated attenuation can be determined using a look-up table. The controller can determine an updated permittivity value for matching the resonant frequency indicated by the resonant system control signal 137. For example, the controller 136 can determine the permeability of the fluidic components based upon the fluidic component mix ratios or discrete volume ratios of different fluidic components and determine an amount of permeability and/or permittivity that is necessary to achieve the indicated resonant frequency or impedance for the determined permeability or determined permeability.

The controller 136 can cause the composition processor 101 to begin mixing two or more component parts in a proportion to form conductive fluid that has the updated loss tangent and permittivity values determined earlier. In the case that the high loss component part also provides a substantial portion of the permeability in the conductive fluid, the permeability will be a function of the amount of high loss component part that is required to achieve a specific attenuation. However, in the case that a separate high loss tangent fluid is provided as a high loss component part, the loss tangent can be determined independently of the permeability. This mixing process can be accomplished by any suitable means. For example, in FIG. 1 a set of proportional valves 134 and mixing pump 120 are used to mix component parts from reservoirs 122, 124, 126 appropriate to achieve the desired updated loss tangent, permittivity and permeability values.

In step 410, the controller causes the newly mixed conductive fluid (or discrete and separate volumes of different conductive fluid-see FIGS. 2 and 3) 108 to be circulated into the resonant cavity 102 through a second mixing pump 121 or through discrete cavities as shown in FIGS. 2 & 3. In step 412, the controller checks one or more sensors 116, 118 to determine if the conductive fluid being circulated through the resonant cavity 102 has the proper values of loss tangent, permittivity and permeability. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The loss tangent is the ratio at any particular frequency between the real and imaginary parts of the impedance, and the impedance can be determined from resistance (R), conductance (G), inductance (L) and capacitance (C) measurements. Additionally, loss tangent can be easily calculated using a separate resonator device, such as a dielectric ring resonator. Such cavity resonator devices are commonly used to compute the quality factor, Q, from which loss tangent is easily extracted. The sensors can be located as shown, at the input to mixing pump 121. Sensors 116, 118 are also preferably positioned to measure the loss tangent, permittivity and permeability of the conductive fluid passing through input conduit 113 and output conduit 114. Note that it is desirable to have a second set of sensors 116, 118 at or near the resonant cavity 102 so that the controller can determine when the conductive fluid with updated loss tangent, permittivity and permeability values has completely replaced any previously used conductive fluid that may have been present in the resonant cavity 102.

In step 414, the controller 136 compares the measured loss tangent to the desired updated loss tangent value determined in step 404. If the conductive fluid does not have the proper updated loss tangent value, the controller 136 can cause additional amounts of high loss tangent component part to be added or removed to the mix (or to or from discrete cavities within the resonant cavity) from reservoir 126, as shown in step 415.

If the conductive fluid is determined to have the proper level of loss in step 414, then the process continues on to step 416 where the measured permittivity and permeability from step 412 is compared to the desired updated permittivity or permeability value(s) determined in step 404. If the updated permittivity or permeability value(s) has not been achieved, then high or low permittivity or permeability component parts are mixed, added or removed as necessary, as shown in step 417. The system can continue circulating the conductive fluid through the resonant cavity 102 until the loss tangent, permeability and/or permittivity passing into and out of the resonant cavity 102 are the proper value, as shown in step 418. Once the loss tangent, permeability, and/or permittivity are the proper value, the process can continue to step 402 to wait for the next updated resonant cavity control signal.

Significantly, when updated conductive fluid is required, any existing conductive fluid must be circulated out of the resonant cavity 102. Any existing conductive fluid not having the proper loss tangent and/or permittivity can be deposited in a collection reservoir 128. The fluidic dielectric deposited in the collection reservoir 128 can thereafter be re-used directly as a fourth fluid by mixing with the first, second and third fluids or separated out into its component parts so that it may be re-used at a later time to produce additional conductive fluid. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir. Those skilled in the art will recognize that the specific process used to separate the component parts from one another will depend largely upon the properties of materials that are selected and the invention. Accordingly, the invention is not intended to be limited to the particular process outlined above.

Referring to FIG. 2, a conceptual diagram useful for understanding an alternative embodiment of tunable resonant cavity is shown. The resonant cavity apparatus 200 includes a resonant cavity 202 not unlike resonant cavity 102 of FIG. 1, except that resonant cavity 202 can further include any number of discrete cavities 250 and 252 for carrying separate conductive fluids rather than having a single cavity 102 for receiving a mix of conductive fluids. The resonant cavity 202 can be a cavity enclosed by an electrically or magnetically conductive material and can be fabricated from any material that can be used to construct a resonant cavity. An aperture 204 can be provided in a cavity wall for coupling RF signals to the resonant cavity, for example RF signals propagating in a circuit device.

The different types of conductive fluid can be constrained within the subcavities 250, 252 within the resonant cavity 102 which may be any number of capillary tubes or other cavities or chambers.

The resonant cavity 202 can be used in any circuit that can include any other type of resonant cavity. For example, the resonant cavity 202 can be used in conjunction with an antenna element 260. The resonant cavity 202 also can be used with other circuit devices, for example an oscillator or a filter. Moreover, the resonant cavity 202 can be used as a filter element. Still, there are many other applications where the resonant cavity 102 can be used, and such applications are understood to be within the scope of the present invention.

A composition processor 201 is provided for changing a composition of the conductive fluid to vary the overall permeability and/or permittivity within the resonant cavity 202. A controller 236 controls the composition processor for selectively varying the volume of various conductive fluid in response to a resonant system control signal 237. Volume control enables control of overall permittivity and/or permeability of the resonant cavity as well as control of group velocity and phase velocity of an RF signal within the resonant cavity 202, and thus resonances within the resonant cavity 202. The permittivity and/or permeability also can be adjusted to control the impedance of the resonant cavity. Volume control may also enable the ability to selectively vary the loss tangent of the fluidic dielectric along with the permittivity and/or permeability, to enable the controller 236 to control the Q and bandwidth of the resonant cavity 202.

In particular, the center frequencies at which the resonant cavity 202 resonates are determined by the dimensions of the resonant cavity, for example the distance between opposing walls. A change in permittivity and/or permeability, which results in a change in phase velocity and group velocity of a signal within a resonant cavity, effectively changes the relative dimensions of the resonant cavity with respect to signal wavelength. Accordingly, the controller 236 can control the center frequencies of the cavity resonances by adjusting the volumes of specific fluidic dielectric.

The composition processor 201 can be comprised of a plurality of fluid reservoirs containing component parts of conductive fluid. These can include one or more fluid reservoirs such as reservoirs 228 and 229 that can contain separate conductive fluid. For example one reservoir can have a low permittivity, low permeability component of the conductive fluid and another reservoir can have a high permittivity, high permeability, high loss component of the fluidic dielectric. Those skilled in the art will appreciate that other combinations of component parts may also be suitable based on a particular application and the invention is not intended to be limited to the specific combination of component parts described herein.

A cooperating set of valves and pumps 221, 223, and connecting conduits can be provided as shown in FIG. 2 for selectively adding or removing the components of the conductive fluid from the fluid reservoirs 228 and 229 to the discrete cavities or subcavities 250, 252 within the resonant cavity 202. All of the various operating functions of the composition processor can be controlled by-controller 236.

The operation of the composition processor 201 operates similar to the composition processor 101 of FIG. 1 and can generally follow the process previously described in connection with the flowchart of FIG. 4. The process can begin in step 402 of FIG. 4, with controller 236 checking to see if an updated resonant system control signal 237 has been received on a controller input line 238. If so, then the controller 236 continues on to step 404 to determine an updated loss tangent value, an updated permittivity value, and/or an updated permeability value. For example, the controller 236 can determine the permeability and/or permittivity of the resonant cavity based upon the fluidic component volume ratios in the various cavities and determine an appropriate volume for a given component using look-up tables (for known component conductive fluids) to achieve a desired overall permittivity or permeability or even a loss tangent value.

In step 410, the controller causes the discrete and separate volumes of different conductive fluids residing in the subcavities 250 and 252 to be circulated into the resonant cavity 202 through pumps 221 and 223. In step 414, the controller 236 can compare a measured loss tangent, permeability or permittivity to desired value(s) determined in step 404. If the conductive fluid does not have the proper updated value(s), the controller 236 can cause additional amounts of a given conductive fluid to be added or removed to or from the discrete cavities or subcavities (250 and 252) within the resonant cavity and to and from reservoirs 228 and 229, as shown in step 415. A simple embodiment may just require a full or empty cavity, but the present invention certainly contemplates partially filled cavities or subcavities to accomplished the desired results. An embodiment with many small cavities as shown in FIG. 3 would be more suitable for having a system where cavities are either empty or full.

If the conductive fluid is determined to have the proper level of loss in step 414, then the process continues on to step 416 where the measured permittivity and permeability from step 412 is compared to the desired updated permittivity or permeability value(s) determined in step 404. If the updated permittivity or permeability value(s) has not been achieved, then high or low permittivity or permeability component parts are added or removed as necessary, as shown in step 417. The system can continue circulating the conductive fluid(s) through the resonant cavity 202 until at least one among the loss tangent, permeability and/or permittivity passing into and out of the resonant cavity 202 are the proper value, as shown in step 418. Once the loss tangent, permeability, and/or permittivity are the proper value, the process can continue to step 402 to wait for the next updated resonant cavity control signal.

Referring to FIG. 3, a resonant cavity 300 similar to resonant cavity 200 of FIG. 2 is shown. The differences between the embodiments of FIG. 2 and FIG. 3 include many more discrete cavities or subcavities 320 as well as optional cavities 318 within an enclosure 302 that are formed substantially orthogonal to the subcavities 320 as shown. The subcavities 320 can be capillary tubes fed by a plurality of feed lines 314. The cavities 318 can have their own feed lines or tap into the feed lines as shown with the tap line 316. The enclosure can further include an aperture 324 and an antenna element 322 as shown. As in the prior embodiments, the resonant cavity 300 may further include a cooperating set of valves and pumps 312 (one shown for simplicity), controller 310 and reservoirs 304, 306, and 308. The resonant cavity 300 would operate in very much the same fashion as the resonant cavity 200 except that the many numerous discrete or subcavities 320 would enable finer tuning than a system have fewer and larger cavities, particularly in a system that would use either completely filled cavities or empty cavities.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A resonant cavity, comprising:

a metalized enclosure forming a cavity and further having a plurality of subcavities, wherein the plurality of subcavities are designed for receiving at least one conductive fluid having a permeability;

at least one fluidic pump unit for moving said at least one conductive fluid among at least one of said plurality of subcavities and a reservoir for adding and removing said conductive fluid to and from said at least one of said plurality of subcavities in response to a control signal.

2. The resonant cavity according to claim 1 further comprising a dielectric barrier within an aperture in the metalized enclosure, said dielectric barrier preventing conductive fluid from escaping said resonant cavity through said aperture.

3. The resonant cavity according to claim 1, wherein the resonant cavity further comprises at least one aperture in said metalized enclosure for coupling said resonant cavity to an RF signal propagating in a circuit device wherein said circuit device is an antenna element.

4. The resonant cavity according to claim 3 wherein said circuit device is selected from a group comprising an oscillator and an antenna element.

5. A tunable resonant system, comprising:

a resonant cavity apparatus including a plurality of cavity walls made of a conductive material and arranged to form a resonant cavity and at least one subcavity within said resonant cavity, at least one of said cavity walls having at least one aperture therein for coupling said resonant cavity to an RF signal propagating in a circuit device, wherein at least one subcavity within said resonant cavity is constructed to receive a conductive fluid;

at least one composition processor adapted for dynamically changing a composition of said conductive fluid to vary a resonant frequency of the resonant cavity; and a controller for controlling said composition processor in response to a resonant system control signal.

6. The tunable resonant system according to claim 5 wherein said controller causes said composition processor to selectively vary a volume of the conductive fluid in response to said resonant system control signal.

7. The tunable resonant system according to claim 5 wherein said controller causes said composition processor to selectively vary a volume in each of a plurality of subcavities within the resonant cavity in response to said resonant system control signal.

8. The tunable resonant system of claim 5, wherein the at least one subcavity comprises a plurality of capillary tubes within the resonant cavity.

9. The tunable resonant system according to claim 5 wherein each of said at least one composition processor is independently operable for adding and removing said conductive fluid from each subcavity of said at least one subcavity.

10. The tunable resonant system according to claim 5 wherein said conductive fluid is comprised of an industrial solvent.

11. The tunable resonant system of claim 10 wherein said conductive fluid is comprised of the industrial solvent having a suspension of magnetic particles contained therein.

12. The tunable resonant system according to claim 11 wherein said magnetic particles are formed of a material selected from the group consisting of ferrite, metallic salts, and organo-metallic particles.

13. The tunable resonant system according to claim 11 wherein said conductive fluid contains between about 50% to 90% magnetic particles by weight.

14. A tunable resonant system, comprising:

a resonant cavity apparatus including a plurality of cavity walls made of a conductive material and arranged to form a resonant cavity and at least one subcavity within said resonant cavity, at least one of said cavity walls having at least one aperture therein for coupling said resonant cavity to an RF signal propagating in a circuit device;

wherein at least one subcavity within said resonant cavity is constructed to receive a conductive fluid, said conductive fluid having a permeability;

at least one composition processor adapted for dynamically changing a composition of said conductive fluid to vary a resonant frequency of the resonant cavity; and a controller for controlling said composition processor in response to a resonant system control signal.

15. The tunable resonant system according to claim 14 wherein said controller causes said composition processor to selectively vary a volume of the conductive fluid in response to said resonant system control signal.

16. The tunable resonant system according to claim 14 wherein said controller causes said composition processor to selectively vary a volume in each of a plurality of subcavities within the resonant cavity in response to said resonant system control signal.

17. The tunable resonant system of claim 14, wherein the at least one subcavity comprises a plurality of capillary tubes within the resonant cavity.

18. The tunable resonant system according to claim 14 wherein each of said at least one composition processor is independently operable for adding and removing said conductive fluid from each subcavity of said at least one subcavity.

19. The tunable resonant system according to claim 14 wherein said conductive fluid is comprised of an industrial solvent.

20. The tunable resonant system of claim 19, wherein said conductive fluid is comprised of the industrial solvent having a suspension of magnetic particles contained therein.

21. The tunable resonant system according to claim 20 wherein said magnetic particles are formed of a material selected from the group consisting of ferrite, metallic salts, and organo-metallic particles.

22. The tunable resonant system according to claim 20 wherein said conductive fluid contains between about 50% to 90% magnetic particles by weight.

23. A method for discretely varying the resonant characteristics of a resonant cavity comprising the steps of:

at least partially filling the resonant cavity with a conductive fluid; and dynamically changing a volume of said conductive fluid to selectively vary at least a resonant frequency of the resonant cavity in response to a resonant system control signal that varies based at least in part upon conductance of the conductive fluid.

24. A method for discretely varying the resonant characteristics of a resonant cavity comprising the steps of:

at least partially filling the resonant cavity with a conductive fluid comprising the step of at least partially filling a plurality of discrete cavities within the resonant cavity with the conductive fluid; and dynamically changing a volume of said conductive fluid to selectively vary at least a resonant frequency of the resonant cavity in response to a resonant system control signal.

25. The method according to claim 24, further comprising the step of selectively adding and removing a conductive fluid from selected ones of the plurality of said discrete cavities of the resonant cavity in response to a control signal.

* * * * *